US005077999A

United States Patent [19]

Rohde

[11] Patent Number: 5,077,999

[45] Date of Patent: Jan. 7, 1992

[54] FLYING UPSETTING PRESS

[75] Inventor: Wolfgang Rohde, Dormagen-Nievenheim, Fed. Rep. of Germany

[73] Assignee: SMS Schloemann-Siemag Aktiengesellschaft, Düsseldorf, Fed. Rep. of Germany

[21] Appl. No.: 530,029

[22] Filed: May 29, 1990

[30] Foreign Application Priority Data

May 29, 1989 [DE] Fed. Rep. of Germany ..... 3917398

[51] Int. Cl.[5] ..... B21J 7/18

[52] U.S. Cl. ..... 72/184; 72/406

[58] Field of Search ..... 72/184, 189, 190, 406, 72/452, 206; 29/527.5, 527.7

[56] References Cited

U.S. PATENT DOCUMENTS

| | | | |
|---|---|---|---|
| 3,114,276 | 12/1963 | Uebing et al. | 72/184 |
| 3,583,192 | 6/1971 | Kocks | 72/406 |
| 4,852,383 | 8/1989 | Nikaido et al. | 72/407 |

FOREIGN PATENT DOCUMENTS

| | | | |
|---|---|---|---|
| 1171245 | 5/1964 | Fed. Rep. of Germany . | |
| 222651 | 10/1986 | Japan | 72/184 |
| 858996 | 8/1981 | U.S.S.R. | 72/406 |

*Primary Examiner*—Lowell A. Larson
*Attorney, Agent, or Firm*—Toren, McGeady & Associates

[57] ABSTRACT

An upsetting press for reducing the width of rolled material, particularly for reducing the width of slabs in hot wide strip breaking-down trains. The upsetting press includes tool support members arranged on both sides of the slab. The tool support members support pressing tools which face toward each other. For providing a reduction drive, each pressing tool with the corresponding tool support member can be moved essentially in the direction of reduction by at least one rod system actuated by a crank drive. The crank drive is mounted on a crank housing. At one feeding drive acts on the tool support member essentially in the slab feeding direction.

11 Claims, 2 Drawing Sheets

FLYING UPSETTING PRESS

BACKGROUND OF THE INVENTION

1. Field of the Invention

The present invention relates to an upsetting press for reducing the width of rolled material, particularly for reducing the slab width in wide strip hot breaking-down trains. The upsetting press includes two tool support members on which setting tools which face each other are mounted.

2. Description of the Related Art

An upsetting press of the above-identified type is known, for example, from European patent 0,112,516. This known upsetting press includes a pair of pressing tools which are arranged on both sides of a slab feeding train. The pressing tools have pressing surfaces which face toward each other and serve to press a slab. At least one of these pressing surfaces extends essentially parallel to the slab feeding direction, while the other pressing surface extends obliquely relative to the slab feeding direction. A vibration unit imparts vibrations to the pressing tool having the parallel and inclined surfaces. This known upsetting press further includes a width regulating unit for regulating the position of the pressing tool in the transverse direction of the slab and a control which determines whether the front end of the slab is arranged between the parallel surfaces of the pressing tools and which then actuates the width regulating unit and which actuates the vibration unit after a predetermined pressing action has been carried out. In this known upsetting press, the time required for laterally upsetting the slabs is reduced and the upsetting effect with respect to the slab shape and the slab surface is improved. However, the width regulating unit and the control for the vibration unit are very complicated. The operating and maintenance costs of this known upsetting press are very high in relation to the almost continuous manner of operation of the slab press or upsetting press which can be obtained.

German Offenlegungsschrift 25 31 591 discloses an upsetting press for reducing the width and for reducing the thickness of slabs of different widths which arrive from a continuous casting plant. In the upsetting press, pressure tools which are moved toward each other repeatedly act on the slab. The tool can freely follow the feed of the slab and the tools are actuated in such a way that they carry out a relatively slow working step and a relatively fast idle step. For this purpose, the upsetting press has at least a pair of edge working tools which act perpendicularly on the edges of the slab and means for quickly reciprocating the tools. The tools for reducing the thickness of the slabs being fed are mounted in a frame which is freely pivotable about a crank axis. The crankshaft is driven by a pair of elliptic gear wheels which are mounted in such a way that they reduce the angular speed of the corresponding eccentric shafts during the working step and increase the speed during the idle step. The edge tool for reducing the width of the slab are connected to the crank drive by means of intermediately arranged hydraulic units in such a way that the edge tools can follow the movement of the slab during the operation on the slab without impairing the feeding movement of the slab.

This known upsetting press is also technically too complicated and, thus, too expensive. An adjustment to the feeding speed of the rolled material can only be effected by changing the gear system with the elliptic gear wheels in accordance with the feeding speed of the slab.

In other upsetting presses which work in accordance with the operating principle of flying crank shears, the selected crank radius inevitably results in a certain relation between the number of strokes and the feeding speed of the pressing tool which cannot be changed since the rate of rotation of the main drive shaft is constant. An adjustment to the feeding speed of the rolled material is only possible by operating the main drive with different rates of rotation within a 360° rotation, wherein the rate of rotation in the engagement region must be selected in such a way that the required synchronization between the feeding speeds of the pressing tool and the feeding speed of the slab occurs. Flying presses equipped with such a drive require significant drive power for the cyclical acceleration and deceleration of the masses being moved. In addition, a flying press with the known type of drive produces undesirable cyclical noises. Another disadvantage of the known upsetting press is the fact that the tool support members which carry the pressing tools carry out a pivoting movement during the rotation over 360°. The geometric dimensions must be such that at least in the region of the engagement of the pressing tool within the rolled material, the setting tool is approximately parallel to the side edge of the slab. In view of the required synchronization of the feeding speeds, this further limits the dimensional range of the press.

SUMMARY OF THE INVENTION

It is, therefore, the primary object of the present invention to provide a flying upsetting press of the type disclosed in European patent 0 112 516, which is structurally improved and avoids the disadvantages of the known upsetting presses. In addition, the sequences of movement of the pressing tools perpendicularly and tangentially relative to the slab feeding direction are to be synchronized in a controllable manner, without requiring significant drive power and complicated structure.

In accordance with the present invention, in an upsetting press of the above-described type, for forming a reduction drive, each pressing tool is movable with the corresponding tool carrier member by means of a rod or lever system driven by at least one crank drive essentially in direction of the reduction. The crank drive is mounted on a crank housing and at least one feeding drive is arranged on the tool support member which acts essentially in slab feeding direction.

As a result of the features of the present invention, the sequence of movement of the pressing tools for forging pressing, i.e., perpendicular movement of the pressing tools, is separated from the sequence of movement for feeding, i.e., tangential movement of the pressing tools. The perpendicular movement is effected by means of a two-crank shaft drive onto a rod mechanism which operates as a parallelogram. As a result, pivoting movements of the pressing tools are avoided. Independently of the tangential movement of the pressing tools, each point on the pressing tools moves on an equal curve path. The tangential movement is obtained by means of a feeding drive whose kinematic dimensions depends exclusively on the required feeding movement of the slab. The tangential movement is superimposed on the perpendicular movement for the total movement of the pressing tools. Accordingly, it is an advantage if the feeding drive can be synchronized with the reduction drive in accordance with the feeding movement of the slab.

A further development of the upsetting press according to the present invention provides that the rod system includes two parallel rods of equal length which are connected in an articulated manner to the tool support member. The parallel rods are provided at the crank housing with crank drives having equal crank radii and equal crank angles. In conjunction with the synchronization, this rod system ensures that the movement of the pressing tool is carried out exactly perpendicularly to the direction of movement of the slab. Push rods can also be used instead of the parallel rods. Advantageously, a fixed connection is provided between the crank housing and the feeding drive for obtaining a structural unit with corresponding force compensation.

In accordance with another development of the invention, the feeding drive is a crank drive or a bent lever drive and is synchronized with the main drive for the perpendicular movement, i.e., with the reduction drive for the pressing tools. This construction already makes possible an approximate synchronization of the feeding movement of the pressing tool with the feeding movement of the slab, although only for a single feeding length. If the feeding length is to be changed, the crank radius of, for example, the crank drive must be made adjustable by means of a sliding block construction.

In accordance with a particularly advantageous feature of the invention, the feeding drive is a hydraulic cylinder. The movement of the hydraulic cylinder can be controlled as a distance/time function in such a way that synchronization of the pressing tool with the lateral pressing of the slab is ensured for any feeding length.

Another advantageous feature of the present invention provides that the pressing tool is guided by means of a guide roller which rolls on a guideway which is fixedly mounted in the machine frame. The guideway has such a contour that the perpendicular movement results in a forced tangential movement of such a length which will produce the necessary synchronization. The inclination of the guideway can be changed in order to change the stroke length, so that a sufficiently approximate synchronization of the feeding speed of the pressing tool with the feeding speed of the slab to be pressed is obtained for different lengths.

In accordance with another advantageous feature, the angular position of the rod system is such that the tangential force component of the crank drive is directed during pressing against the direction of the feeding speed of the feeding drive, so that the force of the feeding drive becomes a component of the deforming force during the reduction of the slab width.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
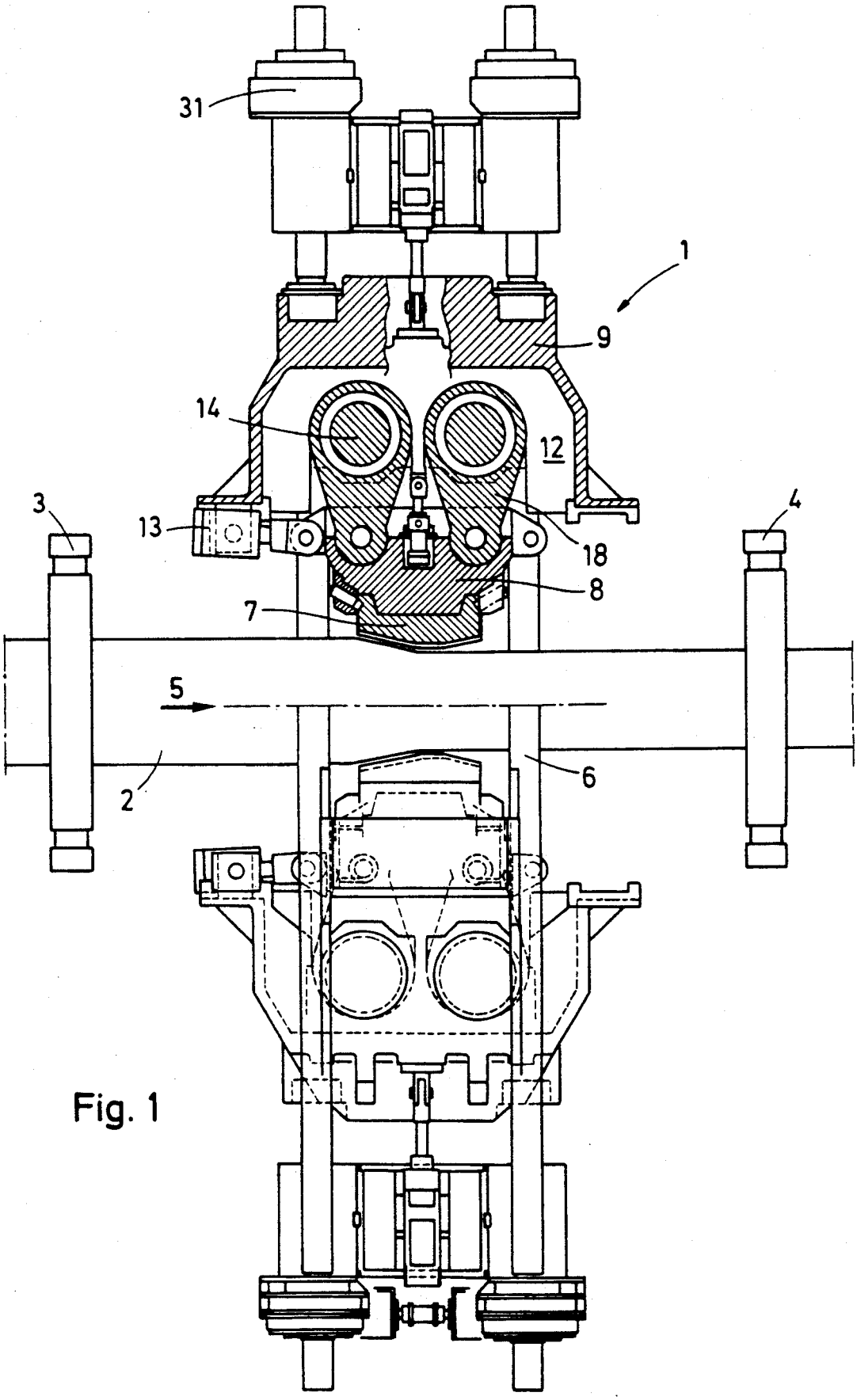
FIG. 1 is a horizontal view, partially in section, of the an upsetting press in accordance with the present invention.

FIG. 1 of the drawing is a horizontal sectional view of a flying upsetting press 1 according to the present invention for reducing the width of slabs 2 in a hot wide strip breaking-down train. The slabs 2 are almost continuously supplied from a slab casting plant, not shown, arranged in front of the upsetting press. Driving rolls 3, 4 are arranged in front of and behind the upsetting press 1. The slab 2 travels through the slab upsetting stand in the direction indicated by arrow 5. The upsetting press 1 includes posts 6. A crank housing 9 is adjustably guided. The adjustment of the crank housing is effected by means of a mechanical adjustment device 31. However, a hydraulically acting piston-cylinder construction can also be used as an adjusting device which is supported by support members 7, 8.

Pressing tools 7 are mounted on both sides of the slab 2. Each pressing tool 7 has a pressing surface 10 extending approximately parallel to the direction 5 of movement of the slab and the other pressing surface 11 extends somewhat inclined and directed against the direction of movement of the slab. The pressing tool 7 includes a reduction drive 12 acting in perpendicular direction, i.e., perpendicularly to the slab 2, and a feeding drive 13 acting in tangential direction, i.e., parallel to the slab 2. The reduction drive 12 is formed by each tool support member being connected so as to be movable essentially in the direction of reduction to a corresponding crank drive 9 by means of a rod system (push rod 18) operated by at least one crank drive (eccentric member 14). The crank drive 15 is arranged in the crank housing 9. The feeding drive 13 acting essentially in slab feeding direction acts on the tool support member 8. The crank housing 9 and the pivot point 29 of the feeding drive 13 form a structural unit by means of the connecting member 30.

Figure 2:
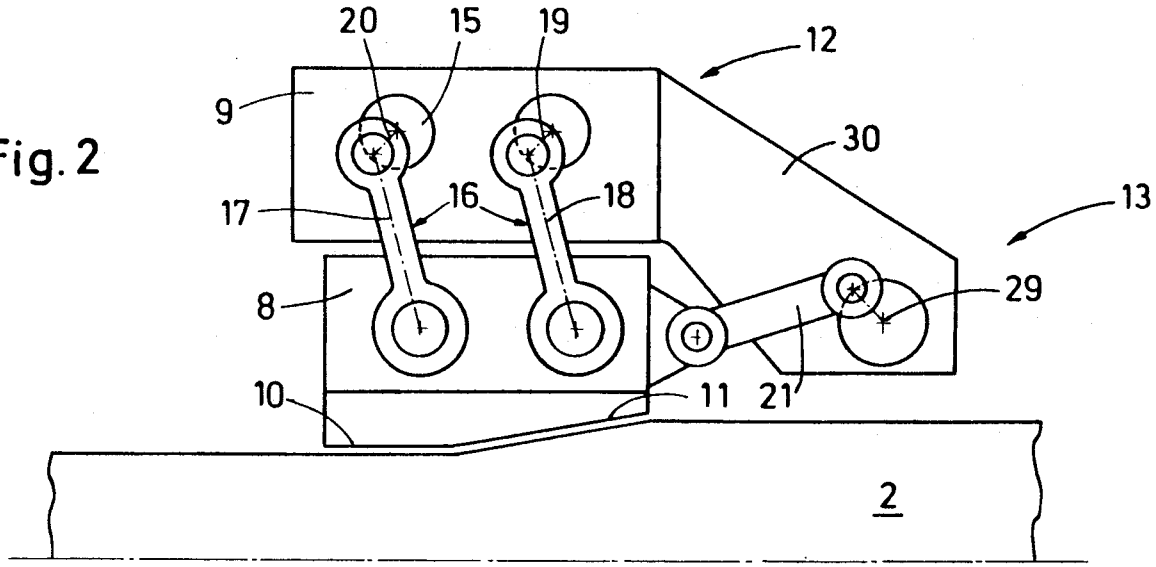
FIG. 2 is a schematic view of the reduction drive with crank-driven parallel rods and of the feeding drive with crank drive.

As illustrated in FIG. 2, the rod system 16 includes two parallel rods 17 and 18 of equal length which are connected to the tool support member 8 in an articulated manner. A crank drive 15 with crank shafts 19, 20 is provided for each of the parallel rods at the crank housing 9. The crank shafts 19, 20 have equal crank radii. The parallel rods are connected in an articulated manner to the crank shafts 19, 20 with equal crank angles. The parallel rods are connected to the tool support members with equal spacing. As a result of this rod system, each point of the pressing tool moves on an equal curve path independently of the tangential movement of the pressing tool. The tangential movement of the pressing tool is effected by the feeding drive 13 which, as shown in FIG. 2, is a crank drive 21. A bent lever drive can be provided instead of the crank drive 21.

The use of a crank drive for the rod system which moves the pressing tool 7 in perpendicular direction and the use of a crank drive for the feeding drive which moves the pressing tool in tangential direction make it possible to synchronize the reduction drive and the feeding drive in accordance with the feeding movement of the slab. The pressing tool 7 can press in perpendicular direction in a quick sequence of the feeding speed of the slab without a relative movement to the slab; the tool 7 can then push ahead and can then return at a distance from the slab; finally, the tool 7 can make contact perpendicularly to the slab side and can press in perpendicular direction again without a relative movement to the slab. It is apparent that the separation of the sequences of movement for forging the slab by means of the pressing tool in perpendicular direction and the feeding of the pressing tool in tangential direction in accordance with the present invention, i.e., the reduction drive and the feeding drive, make it possible to use a significantly lower driving force for the cyclical acceleration and deceleration of the pressing tools and of the tool support members.

Figure 3:
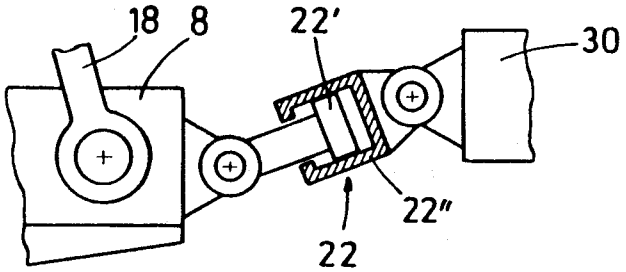
FIG. 3 is a schematic illustration of the feeding drive with hydraulic piston-cylinder units.

If the feeding length of the pressing tool 7 or of the tool support member 8 is to be adjusted within wide ranges of a changing feeding speed of the slab, the feeding drive 13 is formed by a piston-cylinder unit 22, as shown in FIG. 3. The piston-cylinder unit 22 includes a piston 22' at the tool support member 8 and a cylinder 22''' which is connected to the crank drive 9 or to the connecting member 30 of the upsetting press. The piston-cylinder unit 22 can be controlled in accordance with a distance/time function in such a manner that the movement synchronization of pressing tool and slab is ensured for any feeding length. The control and regulating means used for this purpose are state of the art and, therefore, are not explained in detail.

Figure 4:
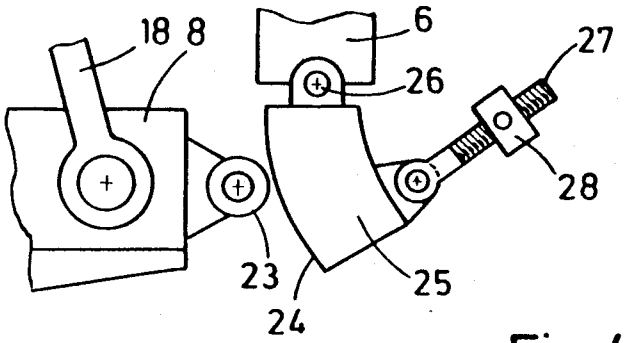
FIG. 4 is a schematic illustration of the feeding drive with guide roller and guideway.

FIG. 4 of the drawing shows the feeding drive 13 for the pressing tool 7 or for the pressing tool support member 8 with a guide roller 23 arranged on the pressing tool. The guide roller 23 runs on a guideway 24. The guideway or the guide member 25 forming the guideway is fastened to the post 6 in a suitable manner by means of a swivel joint 26. The inclination of the guideway can be adjusted by pivoting the guide member in the swivel joint by predetermined angles. For this purpose, an adjusting mechanism is provided which acts on the guide member 25 and the crank housing. The adjusting mechanism may be composed of an adjusting screw 27 connected in an articulated manner to the guide body 25 and of an adjusting nut 28. The adjusting mechanism may also be a piston-cylinder unit which is controllable by means of a hydraulic medium. In this manner, the inclination of the guideway of the guide body can be adjusted in dependence on the selected feeding speed of the slab in such a way that the feeding speed of the pressing tool and the feeding speed of the slab are equal, so that relative movements between the slab and the pressing tool during the lateral upsetting of the slab ar excluded.

The above-described structural principle solves in an excellent manner the problem previously occurring in flying upsetting presses of synchronizing the feeding speed of the pressing tool during the pressing procedure with the feeding speed of the slab. Thus, other detail structures which are not described above are within the scope of the upsetting press according to the present invention to the extent that they meet the claimed technical solution.

For example, the pressing tool 7 may be a high load-bearing member with pressing surfaces 10, 11 which is subject to wear and which can be connected to and disconnected from the tool support member 8. Moreover, the crank drive 15 may be connected to the crank housing 9 on the drive side by means of a conventional spur gear system. The flying upsetting press according to the invention for reducing the slab width can be used in conjunction with conventional devices for reducing the slab thickness.

While a specific embodiment of the invention has been shown and described in detail to illustrate the application of the inventive principles, it will be understood that the invention may be embodied otherwise without departing from such principles.

I claim:

1. In an upsetting press for reducing the width of rolled material, particularly for reducing the width of slabs in hot wide strip breaking-down trains, the upsetting press including tool support members arranged on both sides of the slab, the tool support members supporting pressing tools which face toward each other, the improvement comprising a reduction drive means on each side of the slab, the reduction drive means comprising a rod system with two parallel rods of equal length and a crank drive for each of the two parallel rods of the rod system, the rod system being capable of moving the pressing tool including the tool support member essentially in direction of slab reduction, the crank drives having equal crank radii and equal crank angles and being arranged on a crank housing, and at least one feeding drive connected to the tool support member for acting essentially in slab feeding direction.

2. The upsetting press according to claim 1, wherein the two parallel rods are connected to the tool support member in an articulated manner.

3. The upsetting press according to claim 1, comprising a fixed connection between the crank housing and the feeding drive.

4. The upsetting press according to claim 1, comprising means for synchronizing the feeding drive with the reduction drive in accordance with the feeding movement of the slab.

5. The upsetting press according to claim 1, wherein the feeding drive is a crank drive.

6. The upsetting press according to claim 5, wherein the crank drive has a changeable crank radius.

7. The upsetting press according to claim 1, wherein the feeding drive is a hydraulic piston-cylinder unit.

8. The upsetting press according to claim 7, comprising means for moving the hydraulic piston-cylinder unit in accordance with a distance/time function, such that the pressing tool is synchronized in dependence on the desired feeding length with an almost continuously moved slab.

9. The upsetting press according to claim 1, wherein the feeding drive comprises a guide roller, and a guideway in connection with the guide roller.

10. The upsetting press according to claim 9, comprising means for adjusting the inclination of the guideway in dependence on the selected feeding length, so that the feeding speed of the pressing tool is synchronized with the almost continuously moved slab.

11. An upsetting press for reducing the width of rolled material, particularly for reducing the width of slabs in hot wide strip breaking-down trains, the upsetting press comprising tool support members arranged on both sides of the slab, the tool support members supporting pressing tools which face toward each other, a reduction drive means mounted on each side of the slab, the reduction drive means comprising a rod system with two parallel rods of equal length and a crank drive for each of the two parallel rods of the rod system, the rod system being capable of moving the pressing tool including the tool support member essentially in direction of slab reduction, the crank drives having equal crank radii and equal crank angles and being arranged on a crank housing, and at least one feeding drive connected to the tool support member for acting essentially in slab feeding direction, wherein the rod system is mounted in an angular position such that a tangential force component of the crank drive is directed during pressing against the direction of feeding speed of the feeding drive.

* * * * *